US005246300A

United States Patent [19]

Bloom

[11] Patent Number: 5,246,300

[45] Date of Patent: Sep. 21, 1993

[54] APPARATUS AND METHOD FOR REMOVING PAPER JAMS FROM PRINTERS

[75] Inventor: Thomas E. Bloom, Spokane, Wash.

[73] Assignee: Output Technology Corporation, Spokane, Wash.

[21] Appl. No.: 912,092

[22] Filed: Jul. 9, 1992

[51] Int. Cl.[5] ..... B41J 11/26

[52] U.S. Cl. ..... 400/616.2; 400/679; 226/92; 271/311

[58] Field of Search ..... 400/616.2, 613.1, 644, 400/679; 226/91, 92; 271/307, 308, 311, 313, 900

[56] References Cited

U.S. PATENT DOCUMENTS

| | | | |
|---|---|---|---|
| 4,018,153 | 4/1977 | Freeman | 101/225 |
| 4,251,162 | 2/1981 | Kammerer | 226/91 |
| 4,545,517 | 10/1985 | Olson | 226/92 |
| 4,759,484 | 7/1988 | Richter | 226/92 |
| 4,772,907 | 9/1988 | Marson | 226/92 |
| 5,048,987 | 9/1991 | Golden | 400/613.2 |

*Primary Examiner*—Eugene H. Eickholt
*Attorney, Agent, or Firm*—Wells, St. John, Roberts, Gregory & Matkin

[57] ABSTRACT

An apparatus for removing media jams from a printer throat in a printer in its preferred form is a sheet of flexible material having two linear arrays of spaced pin apertures aligned along opposing sides thereof. The pin apertures are sufficiently spaced to align and mate with pins of a pin drive mechanism of a media feed system. The media feed system advances the apparatus through the printer throat to remove any pieces of media or other debris lodged therein. The sheet of flexible material has a thickness which is at least 50% of the thickness of the printer throat and a compressive strength greater than that of the media or debris lodged in the printer throat. The apparatus provides an efficient, inexpensive, and effective way to remove media jams from a printer. A method for removing media jams using this apparatus is also discussed.

7 Claims, 7 Drawing Sheets

APPARATUS AND METHOD FOR REMOVING PAPER JAMS FROM PRINTERS

TECHNICAL FIELD

This invention relates to an apparatus and method for removing paper jams from a printer.

BACKGROUND OF THE INVENTION

The present invention is particularly suited for continuous form printers which handle continuous form media, such as paper, labels, or multi-part forms. The invention is also suited for many types of printers including impact printers such as dot matrix printers and band printers or non-impact printers such as laser printers and ink jet printers.

FIG. 1 shows a portion of a media feed system 10 used in conventional dot matrix printers. Media feed system 10 includes a pin drive mechanism 12, a platen 14, and media guide 16, and is used to advance media 18 (shown in phantom) through a printer and past a print element (not shown, but typically adjacent platen 14) which places characters or graphics onto media 18. For dot matrix printers, the print element consists of a dot matrix printhead. In other printers, the print element may be, for example, a rotating photosensitive drum used in laser printers, an ink jet assembly, a dot matrix shuttle configuration, a daisy wheel, or a band printing mechanism.

Media 18 is typically continuous, folded paper. Media 18 has a central or main body 20 with opposing side sections 22 and 24. Each side section 22, 24 is easily separable from body 20 along tear or separation lines 23 and 25, respectively. Separation, if necessary, usually occurs after the document has been printed.

Left edge section 22 has a linear array or row of circular drive perforations 26. Similarly, right edge section 24 has a linear array or row of circular perforations 28. Perforations 26 and 28 have substantially the same diameters and a center-to-center spacing "A" which is sufficient to mate with pins of the pin drive mechanism 12, as will be described below in more detail.

Pin drive mechanism 12, as shown, consists of a media feed tractor mechanism which includes left tractor drive 30 and right tractor drive 32 mounted parallel to each other along respective side portions 22 and 24 of media 18. Tractor drives 30, 32 are supported by a support bar or rod 34 which extends therebetween. A lateral adjustment feature 36 is provided to enable adjustment of the lateral distance between tractor drives 30 and 32 to accommodate different width paper and to provide alignment adjustment between the tractor drives. A common drive shaft 38 (illustrated as having a square cross-section) extends between tractor drives 30 and 32 and is operatively connected to a drive mechanism (not shown) for driving the tractor drives in synchronization with the printer system.

Tractor drive 30 includes a continuous drive belt 40 made of a semi-flexible strip material, such as rubber, plastic, or metal. Belt 40 includes pins 42 which have a circular cross-section and are typically conical or "egg-shaped". Pins 42 are spaced apart a distance which is preferably equal to the spaced distance "A" of perforations 26, 28 so that the pins can be inserted into perforations 26 of media 18. Likewise, tractor drive 32 includes a continuous drive belt 44 with pins (not shown) for insertion into perforations 28 along side 24. The pins of the tractor drives mate with perforations 26, 28 of media 18 and, as belts 40 and 44 are rotated, the pins advance media 18 through the printer preferably in a forward direction indicated by arrow 46.

Tractor drive 32 includes a hinged guide plate 48 mounted thereon which swings down over side portion 24 of media 18 for guiding the media through pin drive mechanism 12 and for maintaining the media in substantial engagement with belt 44. Guide plate 48 has a longitudinal slot 50 which permits passage of the pins on belt 44. Tractor drive 30 has a similar guide plate which has been omitted in this figure for purposes of illustration.

Pin drive mechanism 12 advances media 18 in a forward media feed direction as indicated by arrow 46 toward a printer throat, which is referenced generally by numeral 52. The printer throat is typically a narrow passage through which the media is guided prior to being exposed to the print element. In FIG. 1, the printer throat is defined by lower media guide 16, platen 14, and upper media guide 17 (not shown in FIG. 1 for purposes of clarity, but is shown in FIG. 3) disposed above lower media guide 16.

In normal operation, media 18 is advanced by pin drive mechanism 12 through printer throat 52 and around platen 14. Thereafter, the print element (such as a dot matrix printhead) places a desired image onto the media.

Unfortunately, the media sometimes does not pass cleanly through the printer throat, but instead "jams" or becomes caught in the printer throat as illustrated in FIG. 2. This jam causes a ripple or accordion effect to the paper as illustrated, and can cause tearing at this point. As paper continues to feed, more jamming and tearing occur.

Media jams are a problem that has plagued the printer industry since its inception. Media jams exist despite efforts to design sophisticated paper guide systems intended to prevent such jams. Additionally, the problem becomes more severe as printer speed and throughput increases.

Once a printer user experiences an inevitable media jam, the user first removes continuous form media 18 from the printer throat, and oftentimes, from the printer entirely. Unfortunately, when removing the media, a piece of the media may tear off and remain jammed in the printer throat as illustrated diagrammatically in FIG. 3 by crumpled piece 60 lodged within printer throat 56. In addition to pieces of media, foreign matter or debris may become lodged in the printer throat. The user then reloads the media and attempts to refeed it through the printer throat. Again, the media feeds improperly and becomes jammed in the printer throat as shown in FIG. 2 because piece 60, which is still lodged in printer throat 56, prevents the media from passing therethrough. The unload/refeed cycle is then repeated without success.

Once the user realizes that a piece of media is stuck in the printer throat, the user typically pursues one of two courses of action. One plan is to attempt to physically remove the piece of media stuck in the printer throat without disassembling the printer. As illustrated in FIG. 4, the user may attempt to dislodge the media piece using a thin instrument 62 such as a screwdriver, knife, file, or the like. However, the printer throat is usually located in a very difficult location to access, if not completely inaccessible, by the user. For the printer shown in FIG. 4, the printer throat may, for example, be positioned beneath platen 14 in a location inaccessible to instrument 62. More importantly, using a thin instrument 62 in an attempt to dislodge the media piece stuck in the printer throat can damage fragile components within the printer, including the media guides which define the printer throat. Such damage can result in significant repair cost and printer down time.

An alternative plan is to disassemble the printer by removing platen 14 to gain access to the printer throat. For unsophisticated users, this alternative involves a service call to the printer company's service representative. This can result in significant expense in terms of service costs and printer down time while waiting for a service representative to come and repair the printer. Even for the sophisticated user who is capable of disassembling the printer without the assistance of a service representative, printer down time still causes a tremendous inconvenience.

As may be appreciated from these examples, media jams present a significant problem in printers. Removal of such media jams may consume a significant amount of time while the user attempts to remove the jam using an instrument, or disassembles the printer. Moreover, present techniques for removing media jams may damage the printer.

The present invention provides a simple, inexpensive, and timesaving way to remove media jams from printers.

BRIEF DESCRIPTION OF THE DRAWINGS

Preferred embodiments of the invention are described with reference to the following accompanying figures.

FIG. 7 is a cross-sectional view of a media feed mechanism and printer throat for illustrating the removal of a piece of media previously lodged in the printer throat.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 5:
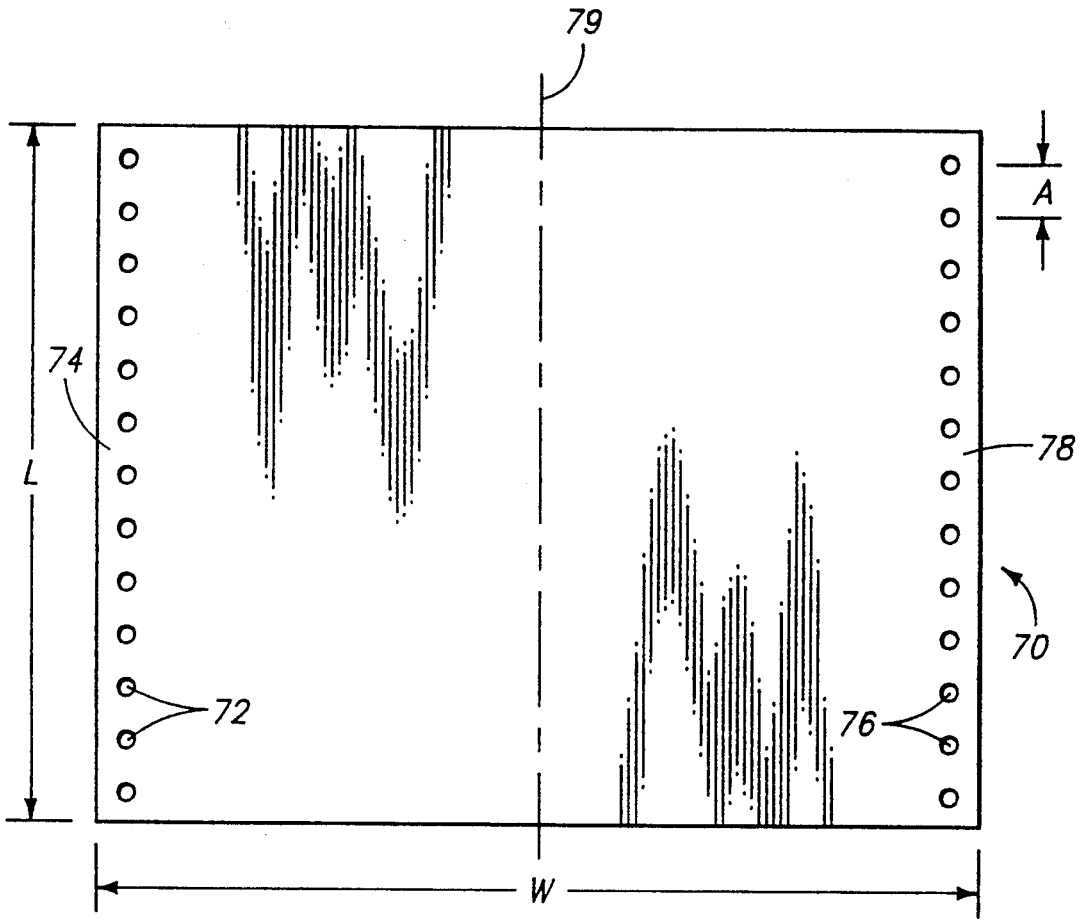
FIG. 5 is a top plan view of a device for removing media jams according to the present invention.

A preferred embodiment of the present invention will now be described with reference to FIGS. 5–7. FIG. 5 shows a device 70 for removing media jams from a printer throat in a printer. Device 70 is a sheet of resilient, flexible material which is preferably vinyl, and will be referred to herein as a printer "dejamming" device. Dejamming device 70 may also be described as a "flexible plate" which is preferably sufficiently rigid to engage, push, and remove debris lodged in a printer, yet flexible enough to be maneuvered through the printer media path.

Dejamming device 70 has one linear array of spaced pin apertures 72 formed along a first side 74 and a second linear array of spaced pin apertures 76 aligned along opposing side 78. Pin apertures 72 and 76 are preferably uniformly spaced a distance "A" along respective opposing sides 74, 78 which is sufficient to receive the pins of a pin drive mechanism of a printer as will be discussed below in more detail.

Figure 6:
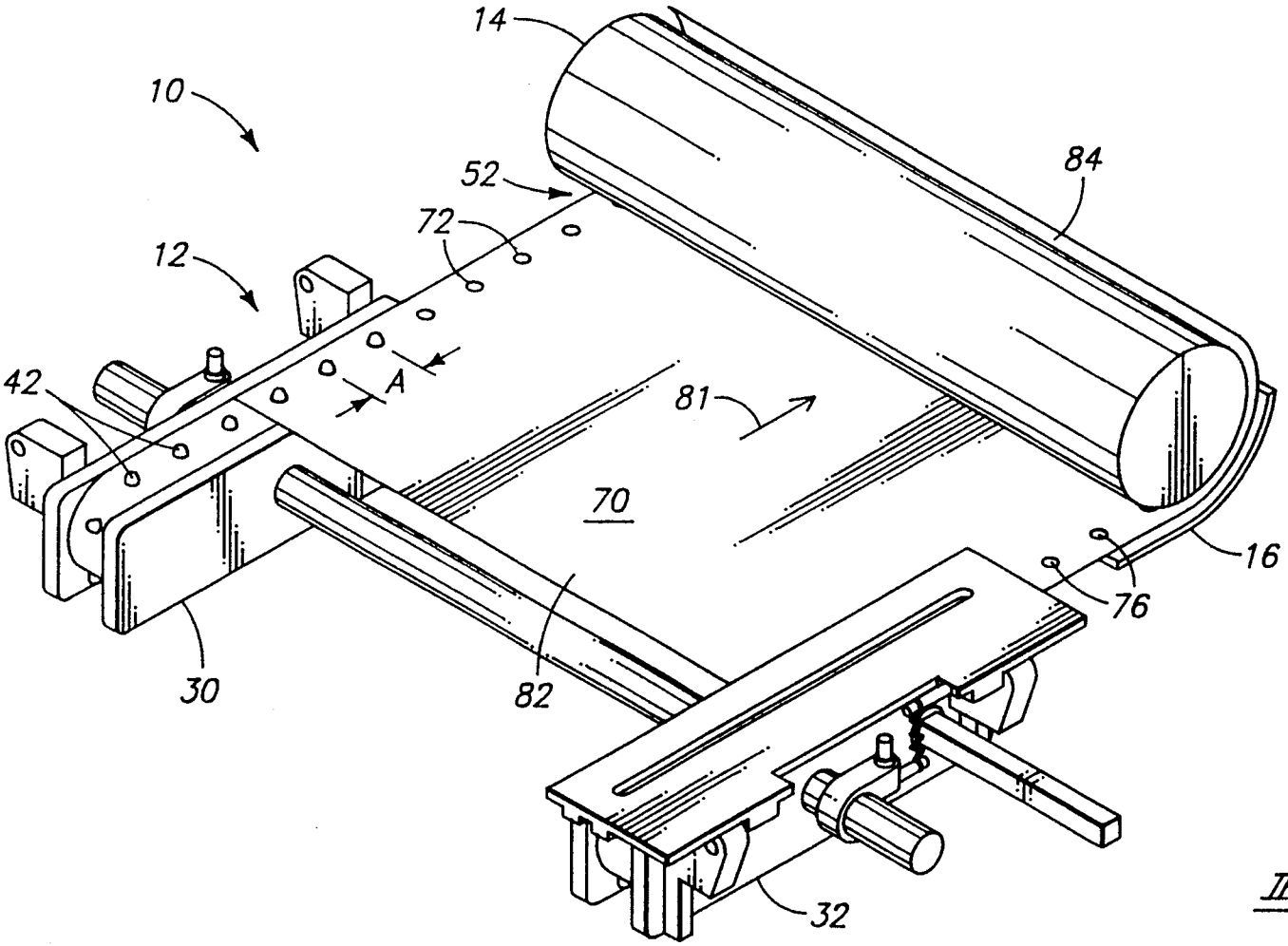
FIG. 6 is a perspective view of a media feed system which demonstrates the operation of the device shown in FIG. 5.
Figure 11:
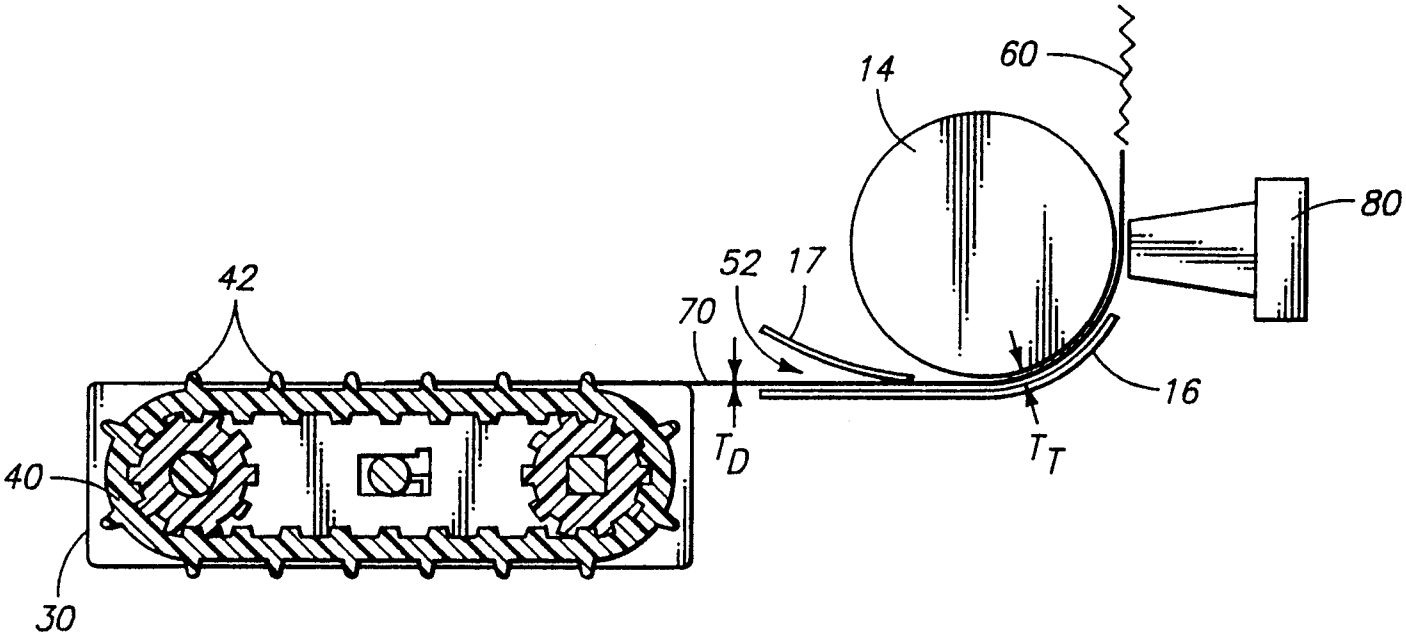

FIGs. 6 and 7 illustrate dejamming device 70 positioned in a media feed system 10 of a conventional dot matrix printer having a dot matrix printhead 80, although the dejamming device is suitable for other types of printers. Media feed system 10 includes a platen 14, media guides 16 and 17, and a pin drive mechanism 12 used to advance continuous form media along a media path through the printer.

Pin drive mechanism 12 in the embodiment shown consists of a media feed tractor mechanism which includes two tractor drives 30 and 32. Each tractor drive has a continuous belt with a plurality of pins mounted thereon for insertion into perforations of print media. In FIG. 7, tractor drive 30 is illustrated as having pins 42 spaced peripherally about a continuous belt 40. The pin drive mechanism illustrated in FIGS. 6 and 7 is provided as one example. The present invention may also be used in other pin drive mechanisms. For example, the dejamming device may be used in a pin drive mechanism having parallel sprockets, whereby each sprocket has a circular hub and a plurality of pins evenly spaced about, and extending radially outward from, the hub. Additionally, the figures illustrate only a single pin drive mechanism in front of the platen. In another printer, a pin drive mechanism may be positioned along the media path after the platen. In still another printer, one pin drive mechanism may be positioned along the media path before the platen and a second pin drive mechanism may be positioned after the platen.

Dejamming device 70 has a width W (FIG. 5) sufficient to extend between tractor drives 30 and 32 (FIG. 6). Specifically, width W is appropriate for left pin apertures 72 to align and mate with pins 42 of tractor drive 30 and for right pin apertures 76 to align and mate with the pins of tractor drive 32. Pin apertures 72 and 76 have a diameter adequate to receive the pins of tractor drives 30, 32. Additionally, distance "A" between adjacent pin perforations provides appropriate spacing to receive adjacent pins. In this manner, tractor drives 30 and 32 can advance dejamming device 70 through the printer and particularly, through a printer throat 52.

Once loaded into pin drive mechanism 12, dejamming device 70 is advanced along the media path in a media feed direction 81 (FIG. 6) through printer throat 52 and around platen 14 in front of printhead 80 (FIG. 7). The sheet of preferably vinyl material provides sufficient flexibility to maneuver along the media path. Printer throat 52 is defined by lower media guide 16, upper media guide 17, and platen 14 and has a defined operational thickness $T_T$ at its narrowest portion. In other systems, more or less media guides and guides of different shapes may be employed to direct the media through the printer and past the print element, and such media guides may be located before or after the print element. Such media guides would define alternatively shaped printer throats. In this application, the term "printer throat" is intended to mean that portion along the media path, typically (although not necessarily) between a feed mechanism (such as a pin drive mechanism) and a location past the print element, which includes the narrowest dimensioned opening or gap in the media path through which media is passed. In the embodiment shown in FIG. 7, printer throat 52 includes the narrowest dimensioned gap having defined thickness $T_T$ defined by platen 14 and lower media guide 16.

Figure 1:
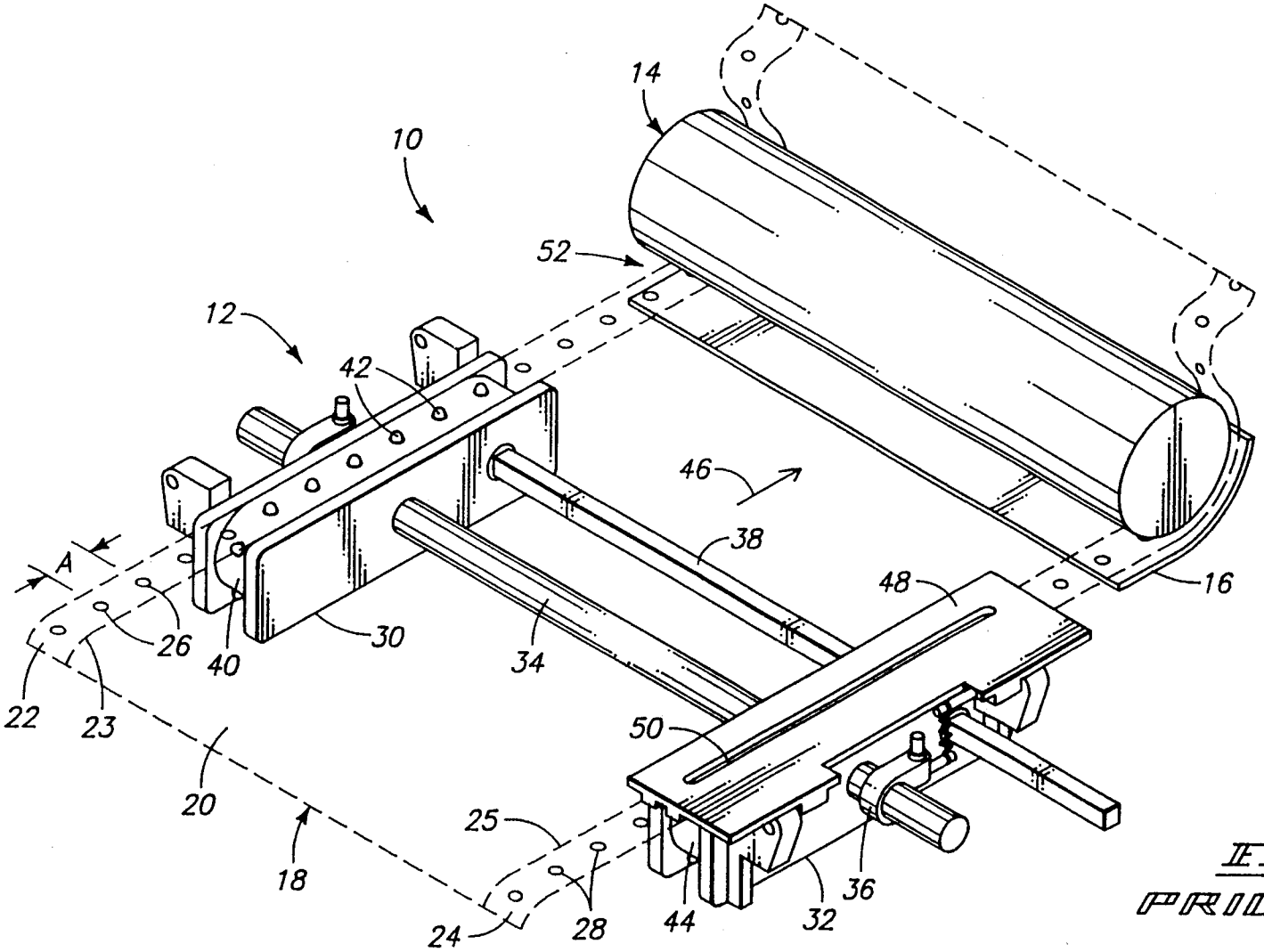
FIG 1 PRIOR ART
FIG. 1 is a perspective view of a media feed system for advancing media through a printer, and particularly through a printer throat.
Figure 2:
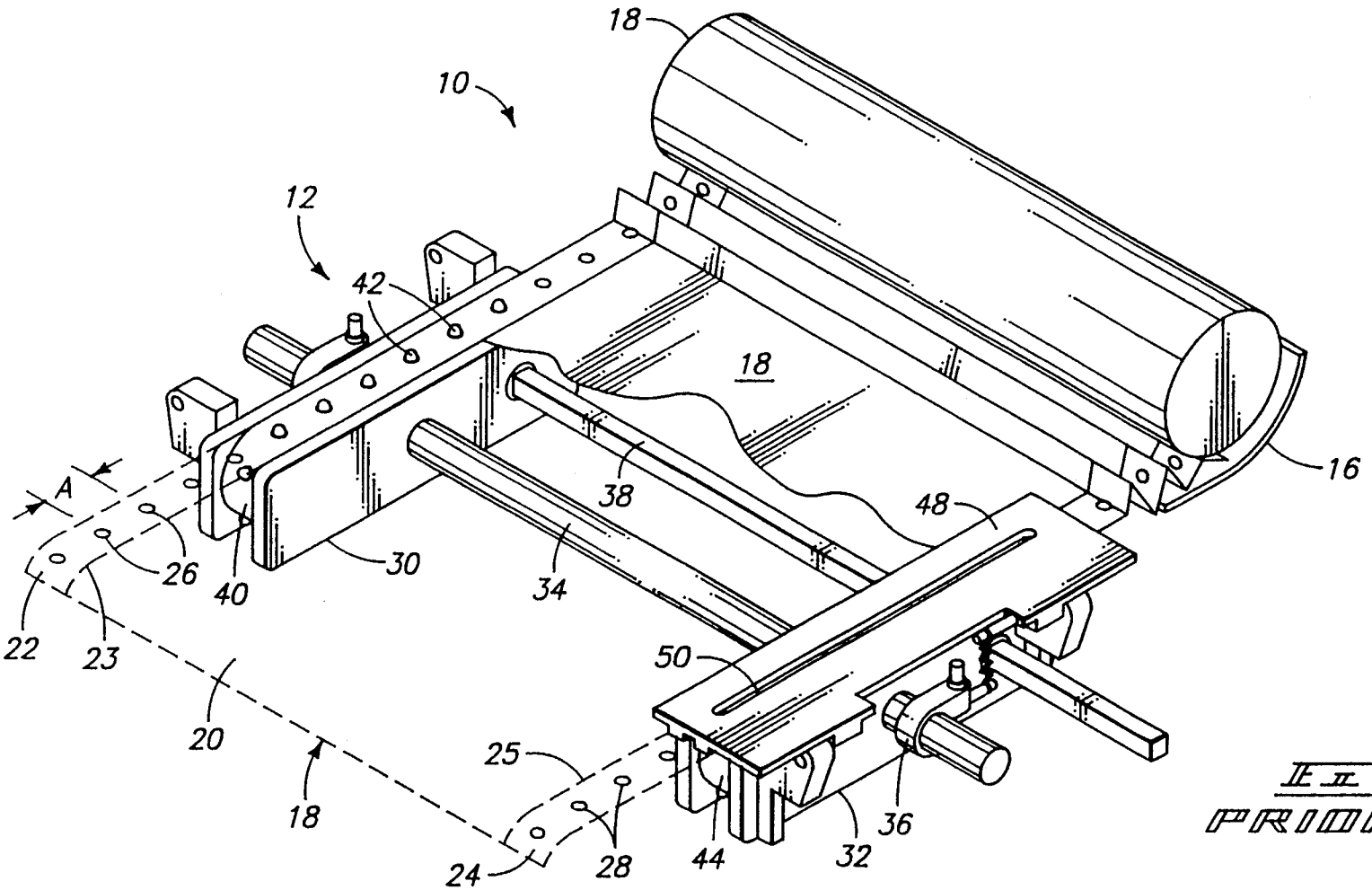
FIG 2 PRIOR ART
FIG. 2 is a perspective view identical to that of FIG. 1 which illustrates problems associated with media jams within the printer throat.
Figure 3:
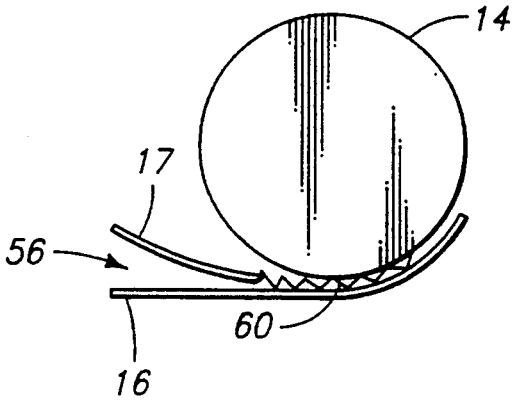
FIG 3 PRIOR ART
FIG. 3 is a diagrammatic side view demonstrating a piece of media or other debris lodged within the printer throat.
Figure 4:
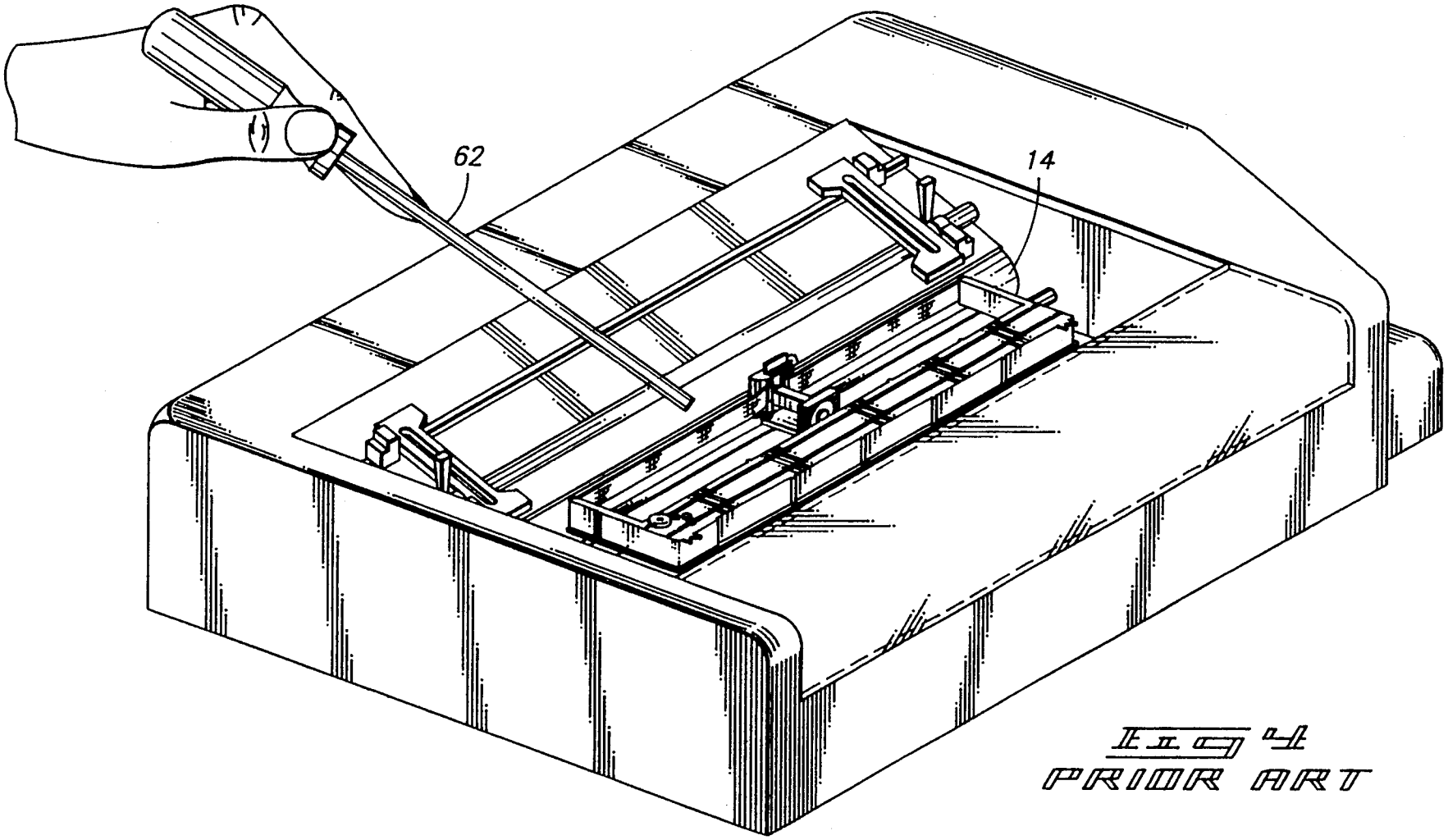
FIG 4 PRIOR ART
FIG. 4 is a perspective view of a printer which illustrates one conventional, prior art technique of removing media jams from printers.

As dejamming device 70 moves through printer throat 52, a front edge of device 70 engages and dislodges any piece of media or foreign debris (referenced generally by numeral 60) previously stuck in the printer throat as shown in FIG. 7. Although the media passed through the printer typically has a thickness less than 50% of the printer throat thickness $T_T$, jammed media usually "bunches up" in an accordion-like manner (see FIG. 3) to block at least partially the media path and thereby prevent a new sheet of media from passing therethrough on a subsequent refeed attempt. To effectively dislodge media piece 60, dejamming device 70 has a thickness sufficient to allow the device to move through the printer throat, yet also remove any media pieces lodged therein. Preferably, dejamming device 70 has a thickness $T_D$ which is at least 50% of defined thickness $T_T$ of printer throat 52 which varies from printer to printer. Most preferably, thickness $T_D$ of dejamming device 70 is 85–95% of thickness $T_T$ of printer throat 52.

Dejamming device 70 also preferably has a compressive strength measured along a transverse axis 79 (FIG. 5) which is greater than the compressive strength of the media or debris lodged in printer throat 52. When the device is operably mounted in pin drive mechanism 12, transverse axis 79 is coincident with media feed direction 81 (FIG. 6). In this manner, dejamming device 70 can effectively push the debris out of printer throat 52 without the device buckling or significantly deforming.

Dejamming device 70 has a length L (FIG. 5) which permits a portion 82 (FIG. 6) of device 70 to be positioned in pin drive mechanism 12 while a second portion 84 extends through printer throat 52. In this manner, dejamming device 70 may be driven through the printer throat by pin drive mechanism 12 and then easily removed from the printer by the user after it has passed through the printer throat.

To remove paper jams according to the present invention, a printer user would first remove the continuous form media from the pin drive mechanism in a jammed printer. The user would then load dejamming device 70 into the printer by placing the device into pin drive mechanism 12. Specifically, the user would align and mate pin apertures 72 and 76 with pins 42 of tractor drive 30 and the pins of tractor drive 32, respectively. The user would then operate the printer to advance dejamming device 70 in media feed direction 81 through (e.g., at least partially through) printer throat 52 of defined thickness $T_T$. Because the sheet of flexible material has a thickness $T_D$ that is at least 50%, and preferably 85–95%, of the defined thickness $T_T$ of the printer throat and sufficient compressive strength, dejamming device 70 effectively removes pieces of media or other debris 60 lodged within printer throat 52 (as shown in FIG. 7). Dejamming device 70 is sufficiently flexible to be maneuvered through the media path and around a platen (if there is one) or other media rollers. A sheet of vinyl material has been proven to possess the desired flexibility and compressive strength characteristics.

After dejamming device 70 has dislodged any pieces of media or other debris from the printer throat, the user removes dejamming device 70 and reloads the continuous form media into the media feed system for continuation of normal printing operation.

The present invention has a significant advantage in that it provides an inexpensive, yet extremely effective way to remove media jams from printers. Another advantage of the invention is that it removes media jams in a very efficient and timesaving manner in comparison with the prior art techniques of attempting to dislodge the jam with a thin instrument or disassembling the printer altogether.

Although the dejamming device is described as removing media jams from within printers, such a device may be adapted to other form feeding systems, such as photocopiers, fax machines, or other similar devices. Preferably, the dejamming device is used in media feed systems having a pin drive mechanism, although it may be adapted for other types of media feed systems, such as tension rollers, or the like.

In compliance with the statute, the invention has been described in language more or less specific as to structural or methodical features. It is to be understood, however, that the invention is not limited to the specific features described or shown, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An apparatus for removing media jams from a printer throat in a printer, the printer having a pin drive mechanism for advancing media of a defined compressive strength in a media feed direction along a media path through a printer throat of a defined thickness, the media having two linear arrays of perforations aligned along opposing sides thereof, the pin drive mechanism having a plurality of pins for insertion into the media perforations for advancing the media, the apparatus comprising a sheet of flexible material having two linear arrays of spaced pin apertures aligned along opposing sides thereof, the pin apertures being spaced to mate with the pins of the pin drive mechanism to enable the printer to advance the sheet in the media feed direction through the printer throat, the sheet of flexible material having a thickness which is at least 50% of the defined thickness of the printer throat and a compressive strength measured along a transverse axis coincident with the media feed direction which is greater than the defined compressive strength of the media.

2. An apparatus for removing media jams according to claim 1 wherein the thickness of the sheet of flexible material is 85–95% of the thickness of the printer throat.

3. An apparatus for removing media jams according to claim 1 wherein the sheet of flexible material has a length which permits a portion of the sheet to be positioned in the pin drive mechanism while another portion of the sheet extends through the printer throat.

4. An apparatus for removing media jams according to claim 1 wherein the flexible material is vinyl.

5. An apparatus for removing media jams from a printer throat in a printer, the printer having a pin drive mechanism for advancing a continuous form media of a defined compressive strength in a media feed direction along a media path through a printer throat of a defined thickness, the continuous form media having two linear arrays of perforations aligned along opposing sides thereof, the pin drive mechanism having a plurality of pins for insertion into the media perforations for advancing the media, the apparatus comprising a sheet of resilient, flexible material having a length which permits a portion of the sheet to be positioned in the pin drive mechanism while another portion of the sheet extends through the printer throat, the sheet of material having two arrays of uniformly spaced pin apertures aligned along opposing sides thereof, the pin apertures being appropriately spaced to operatively mate with the pins of the pin drive mechanism to enable the printer to advance the sheet in the media feed direction through the printer throat, the sheet of flexible material having a thickness which is at least 50% of the defined thickness of the printer throat and a compressive strength measured along a transverse axis coincident with the media feed direction which is greater than the defined compressive strength of the continuous form media.

6. An apparatus for removing media jams according to claim 5 wherein the thickness of the sheet of flexible material is 85–95% of the thickness of the printer throat.

7. An apparatus for removing media jams according to claim 5 wherein the flexible material is vinyl.

* * * * *